United States Patent [19]

Wells

[11] Patent Number: 4,860,803

[45] Date of Patent: Aug. 29, 1989

[54] CONTINUOUS NITROX MIXER

[75] Inventor: J. Morgan Wells, Gaithersburg, Md.

[73] Assignee: The United States of America as represented by the Department of Commerce, Washington, D.C.

[21] Appl. No.: 244,762

[22] Filed: Sep. 15, 1988

[51] Int. Cl.[4] ..... F17C 5/06

[52] U.S. Cl. ..... 141/9; 141/18; 141/83; 141/100; 128/204.22; 422/62; 422/108; 436/55; 137/3

[58] Field of Search ..... 141/2, 9, 18, 22, 37, 141/39, 47, 63, 83 X, 100, 104, 105; 128/201.27, 201.28, 204.22, 205.11, 205.18, 205.25; 422/62, 108; 436/55; 137/3, 5, 88, 93; 48/180.1, 189.1

[56] References Cited

U.S. PATENT DOCUMENTS 3,593,735 7/1971 Reiher ..... 128/204.22
3,799,218 3/1974 Douglass ..... 141/18
4,206,753 6/1980 Fife ..... 128/203.29
4,340,044 7/1982 Levy et al. ..... 128/205.11

*Primary Examiner*—Henry J. Recla
*Assistant Examiner*—J. Casimer Jacyna
*Attorney, Agent, or Firm*—Thomas Zack; Alvin J. Englert; Frank A. Lukasik

[57] ABSTRACT

The continuous NITROX mixer is a pre-calibrated, continuous flow, gas mixing system and a method which combines pure oxygen and air at atmospheric pressure, to create a final mixture of predetermined composition. Constituent gases are regulated to the same pressure and temperature before oxygen is metered through precision micro-metering valves. The system proportions the amounts of each gas and delivers the final mixture to a common mixing chamber. Delivery pressure can be adjusted up to 3000 PSI, making the system suitable for filling SCUBA or storage cylinders.

6 Claims, 2 Drawing Sheets

CONTINUOUS NITROX MIXER

STATEMENT OF GOVERNMENT

The invention described herein may be manufactured by or for the Government of the United States of America for governmental purposes without the payment of any royalties thereon or therefore.

BACKGROUND OF THE INVENTION

This invention relates to a new and improved pre-calibrated, continuous flow, gas mixing system to be used in mixed-gas diving.

Conventional mixing systems are generally constructed from commercially available components. Necessary equipment includes a number of mixed gas cylinders required, an equal number of high pressure oxygen cylinders, a mixing manifold arrangement, an oxygen analyzer and an oxygen booster pump. Gases are mixed intermittently by the following lengthly procedure. First, the multi-cylinder mixing manifold is connected, then the proper sequence of valves must be opened to obtain an estimated inert gas mix. Next the pressure in the cylinders must be calculated after mixing. The next step requires opening the proper sequence of valves to obtain an estimated oxygen gas mix. The mixture is then allowed to set for 6 hours or the cylinder is tumbled to obtain a homogeneous mix. The resulting mixture must be analyzed to determine the oxygen percentage of the resulting mixture. Oxygen must then be added as necessary, reanalyzed and repeated as necessary until the desired mixture is obtained.

Another prior art commercially available continuous flow system cannot be used to fill high pressure cylinders. This electrically powered system supplies mixed gas directly to a diver or hyperbaric system at pressures up to 750 PSI. All components are exposed to high pressure oxygen, therefore gases must be dry and oil free to minimize risk of explosion.

Other prior art devices such as U.S. Pat. No. 3,593,735 to Reiher disclose a method and apparatus for maintaining a preselected oxygen partial pressure in breathing gas supplied to a diver under an abnormal pressure. A mixing tank with separate inputs is provided to receive and blend together oxygen and filler gas according to a preselected ratio as breathing gas is withdrawn from the tank by a diver. This invention does not combine oxygen and air as the instant invention does. U.S. Pat. No. 4,206,753 discloses a method and apparatus for mixing gases wherein oxygen is mixed into hydrogen for use as a breathing gas for divers, pressure chambers, etc., in precise and regulated amounts. The oxygen is injected into the carrier gas from an injection jet. The carrier gas is circulated in repeated passes past the oxygen injection jet in a conduit system. This invention requires hydrogen as a carrier gas and does not combine oxygen and air as the subject invention does.

Unlike the prior art devices, the instant invention does not rely on electric power. The gas mixing console itself does not require power. The compressor can be powered by either gas or electricity. Unlike commercially available continuous flow mixing systems, only the injection system of the instant invention is exposed to pressurized oxygen.

SUMMARY OF THE INVENTION

It is an objective of the invention to provide a breathing gas mixture for divers which significantly extends bottom time and reduces required decompression.

Further it is an objective to provide a breathing gas mixture device which is fast, safe and economical.

It is also an objective to provide a breathing gas mixture device which safely, accurately, and rapidly combines pure oxygen and air at atmospheric pressure to create a final mixture of predetermined composition.

These and other objectives of the invention and the various features and details of construction and operation will become apparent from the specification and drawings.

DESCRIPTION OF THE PREFERRED EMBODIMENT

Figure 1:
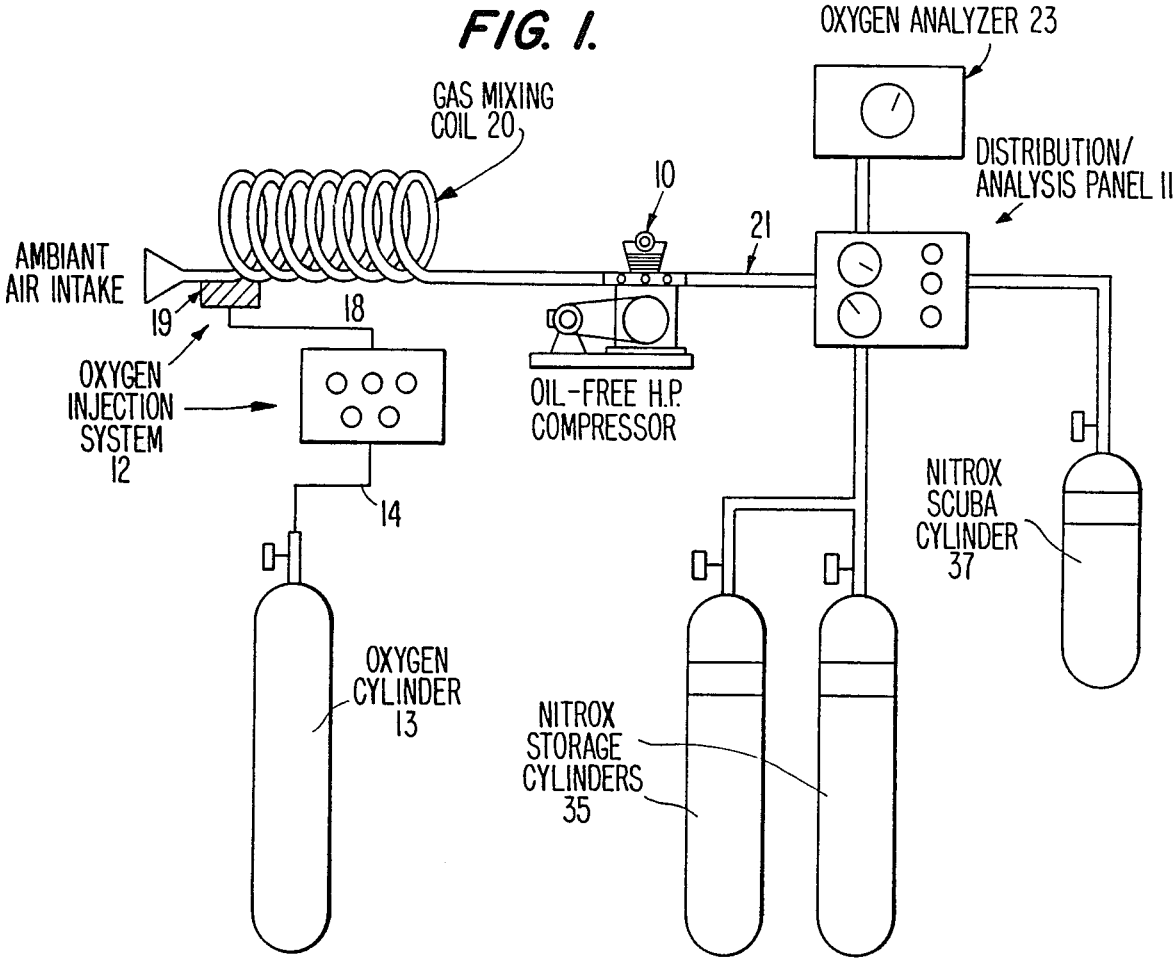
FIG. 1 is a functional representation of a preferred embodiment of a gas mixing system of the instant invention.

FIG. 1 illustrates a functional representation of a continuous mixer which combine pure oxygen and air at atmospheric pressure to create a final mixture (NITROX) of predetermined composition. Constituent gases are regulated to the same pressure and temperature before oxygen is metered through precision micrometering valves. The valve settings are pre-calibrated and display on curves computed for the system. The system proportions the amounts of each gas and delivers the final mixture to a common mixing chamber. Delivery pressure can be adjusted up to 3000 PSI, making the system suitable for filling SCUBA or storage.

Mixture of $N_2/O_2$, other than air have been used with significant advantages in diving and recompression therapy for a number of years. It has been used by divers to reduce decompression obligation (32% $O_2/N_2$ NOAA NITROX I), and as a therapy gas during recompression treatments (50% $O_2/N_2$). Oxygen usage from 21% to 60% is possible. Dive tables which extend bottom time and cut down on decompression are based on 32 percent oxygen mix in the breathing gas. The high oxygen content acts as scrubber and reduces the normal 80 percent nitrogen uptake. Since there is less nitrogen, lessened narcosis comes as a side benefit. Decompression times are shorter than those suggested by the U.S. Navy Air decompression tables because less nitrogen is absorbed by the body. At present, divers are using the NITROX system down to 130 feet.

Figure 2:
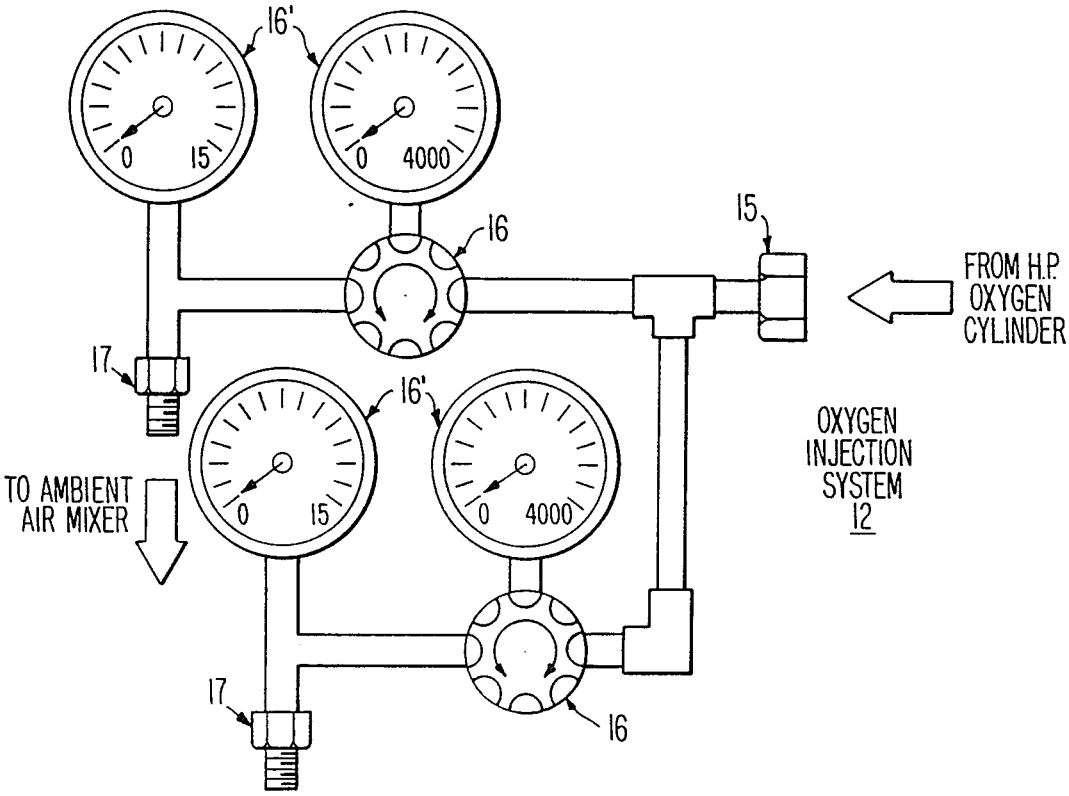
FIG. 2 is a functional representation of an oxygen injection/mixing system of the instant invention.
Figure 3:
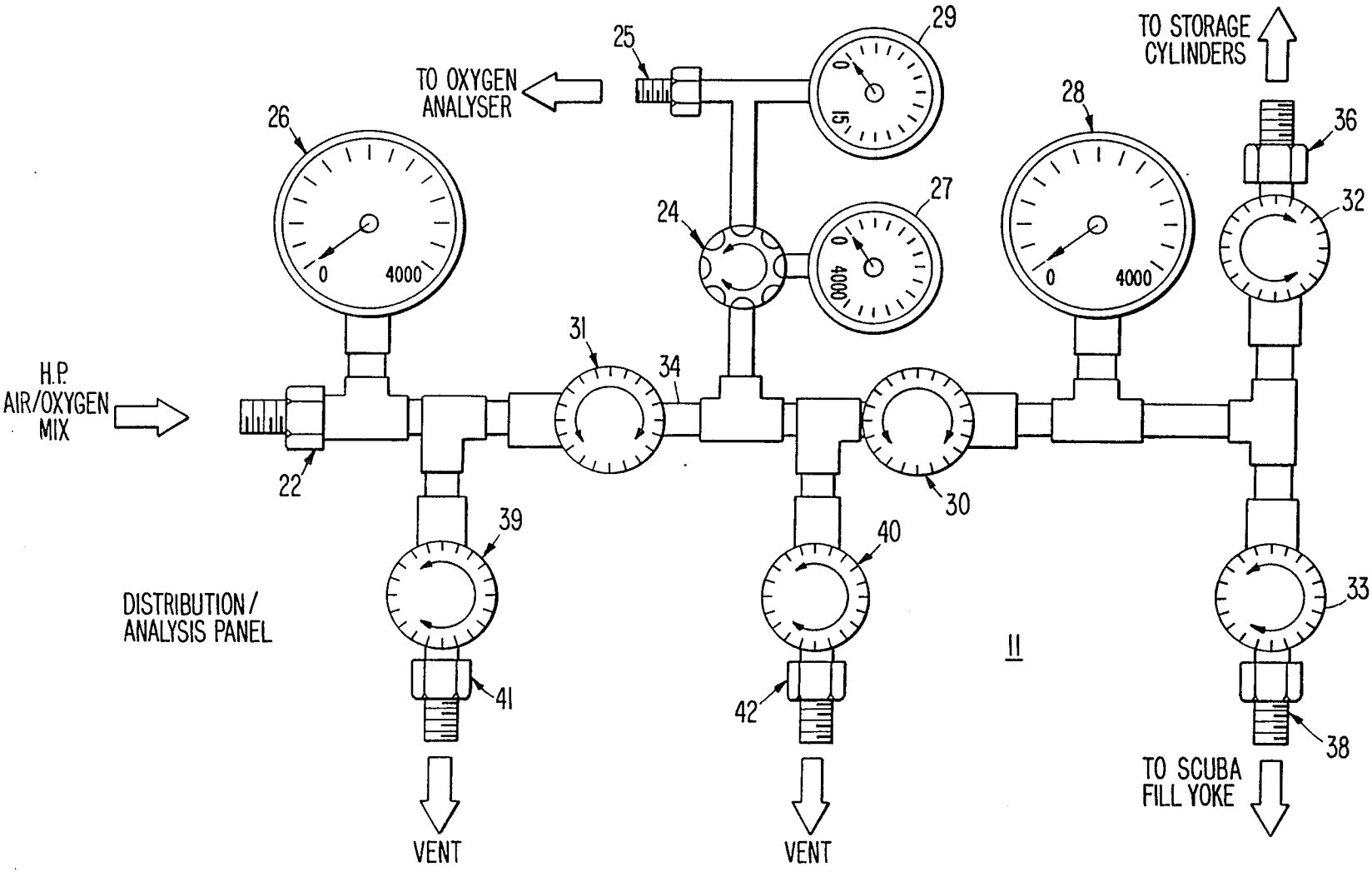
FIG. 3 is a functional representation of a distribution-/analysis manifold of the instant invention.

Apparatus for providing a NITROX gas mixture as shown in FIGS. 1 thru 3 comprises a high pressure compressor 10, distribution/analysis panel 11, and oxygen injection/mixing system 12. Oxygen gas to be mixed with ambient air is fed from oxygen cylinder 13 via feed line 14 to oxygen injection system 12 thru connector 15 to oxygen flowmeters 16 and their related pressure gauges 16' and then via high pressure hose connections 17 and feed line 18 where the oxygen is injected into the air stream thru injector 19. The oxygen/air mixture is then passed thru gas mixing coils 20 into compressor 10. In one embodiment of the instant invention, a standard RIX Oil-Free compressor, model SA-6 was used although other non-oil lubricated compressors may also be used. The compressor 10 may be powered by either gas or electricity. Extreme care is necessary with commercial systems to ensure that gasses and equipment are oil-free. Constituent gases are regulated to the same pressure and temperature before oxygen is metered through precision micro-metering valves such as oxygen flowmeter 16. The valve settings are pre-calibrated and displayed on curves computed for the system. These curves relate the final mixture percentages to the amounts of each gas and delivers the final mixture to a common mixing chamber such as mixing coils 20.

The compressed oxygen and air mixture (NITROX) is provided thru conduit 21 to high pressure hose connection 22 ont he distribution/analysis panel 11. Delivery pressure can be adjusted up to 3000 PSI. In order to precisely measure the amount of oxygen injected by the oxygen injection system 12, into the airstream and the gas mixing coils 20, an oxygen analyzer 23 is connected through a flowmeter 24 and hose connection 25. Flowmeter 24 is open during mixing so that gases in gas mixing coils 20 and compressor 10 may be analyzed in oxygen analyzer 23. Pressure gauges 26, 27, and 28 are also in fluid communication with the oxygen/air mixture from the output of compressor 10. Flowmeter indicatior 29 shows the number of liters per minute going to the oxygen analyzer. Readings on the oxygen analyzer 10 provide an operator with an indication of the necessary adjustments to be made in oxygen injectin system 12. Control Valves 30, 31, 32, and 33 are connected in output conduit 34 thus permitting connection through suitable conduits to storage cylinders 35 through control valve 32 and hose connection 36 and SCUBA cylinder 37 through control valve 33 and hose connection 38. Control valves 39 and 40 are also in fluid communication with the oxygen/air mixture and may be vented thru hose connections 41 and 42.

The continuous NITROX mixer of the instant invention is extremely compact. The entire console measures only 3 feet by 1 foot by 8 inches, weighs approximately 8 pounds and can be carried by one man. The oxygen injection system 12 and mixing coils 20 weigh approximately 10 pounds.

While the invention has been described in its preferred embodiment, it is to be understood that the words which have been used are words of description rather than limitation and that changes may be made within the perview of the appended claims without departing from the true scope and spirit of the invention in its broader aspects.

What is claimed is:

1. A system for forming precise and regulated mixture percentages of oxygen and air in a breathing gas comprising:

means for supplying a stream of oxygen gas;

means for injecting said oxygen into a stream of ambient air;

means for mixing said oxygen and ambient air;

means for compressing said mixed gas stream; and means for analyzing and distributing said compressed gas stream into high pressure storage tanks.

2. The system described in claim 1 wherein said means for injecting said oxygen comprises pre-calibrated precision micro-metering valves programmed to provide precise proportions of oxygen air.

3. The system described in claim 1 wherein said means for compressing said mixed gas stream comprises a non-oil lubricated high pressure compressor.

4. A method of mixing precise and regulated mixtures of oxygen and air in a breathing gas comprising:

providing a fluid stream of ambient air;

injecting oxygen through precision micro-metering valves into said fluid stream;

mixing said oxygen containing fluid stream;

compressing said fluid stream to a high pressure breathing gas up to 3000 PSI;

measuring the percentage of the oxygen in said breathing gas; and transferring said breathing gas into high pressure storage tanks.

5. The method of claim 4 wherein said step of injecting oxygen through precision micro-metering valves into said fluid stream is programmed to provide precise proportions of oxygen to air of between 21 percent and 60 percent of oxygen.

6. A system for forming a precise and regulated mixture percentages of oxygen and air in a breathing gas comprising:

gas intake means for supplying a stream of ambient air;

an oxygen gas supply for providing oxygen to be mixed;

oxygen injection means having pre-calibrated precision micro-metering valves programmed to provide precise proportions of oxygen to said stream of ambient air;

a mixing chamber couples with said gas intake means for mixing said oxygen and air stream;

a non-oil lubricated high pressure compressor coupled to said mixing chamber for increasing the pressure of said oxygen and air stream to desired pressure up to 3000 PSI; and oxygen analyzing and distributing means coupled to said compressor and adapted to measure the percentage of oxygen in said oxygen and air stream and transferring said breathing gas into a high pressure storage means.

* * * * *